US005161277A

United States Patent [19]

Ingermann et al.

[11] Patent Number: 5,161,277

[45] Date of Patent: Nov. 10, 1992

[54] VARIABLE SPEED TRANSFER ROLLER FOR BOWLING LANE DRESSING APPARATUS

[75] Inventors: Donald E. Ingermann, Evergreen; Ronald L. Smith, Boulder, both of Colo.

[73] Assignee: AMF Bowling, Inc., Golden, Colo.

[21] Appl. No.: 775,841

[22] Filed: Oct. 15, 1991

[51] Int. Cl.[5] ..... A63D 5/10; A47L 11/282

[52] U.S. Cl. ..... 15/98; 15/4; 15/103.5; 118/262

[58] Field of Search ..... 15/4, 98, 103.5; 118/262

[56] References Cited

U.S. PATENT DOCUMENTS

| | | | |
|---|---|---|---|
| 3,216,037 | 11/1965 | Stevens et al. | 15/98 |
| 3,868,738 | 3/1975 | Horst et al. | 15/98 |
| 4,959,884 | 10/1990 | Ingermann et al. | 15/98 |

*Primary Examiner*—Edward L. Roberts

*Attorney, Agent, or Firm*—Fields, Lewis, Pittenger & Rost

[57] ABSTRACT

In accordance with this invention, a bowling lane dressing apparatus is provided which has a carriage for movement along the bowling lane between the foul line and the pit. Drive wheels are rotatably mounted on the carriage for moving the carriage along the bowling lane by means of drive means connected thereto. A lane buffer roller is journaled on the carriage in lane-contacting relation which extends transversely to the direction of travel. A reservoir is mounted in the carriage for storage of lane-dressing fluid. A transfer roller is mounted in rolling engagement with the lane buffer roller and in fluid communication with the reservoir for transferring fluid from the reservoir to the lane buffing roller. Variable speed drive means is connected to the transfer roller for rotating it at variable speeds to vary the rate of transfer of fluid from the reservoir to the lane buffer roller.

6 Claims, 2 Drawing Sheets

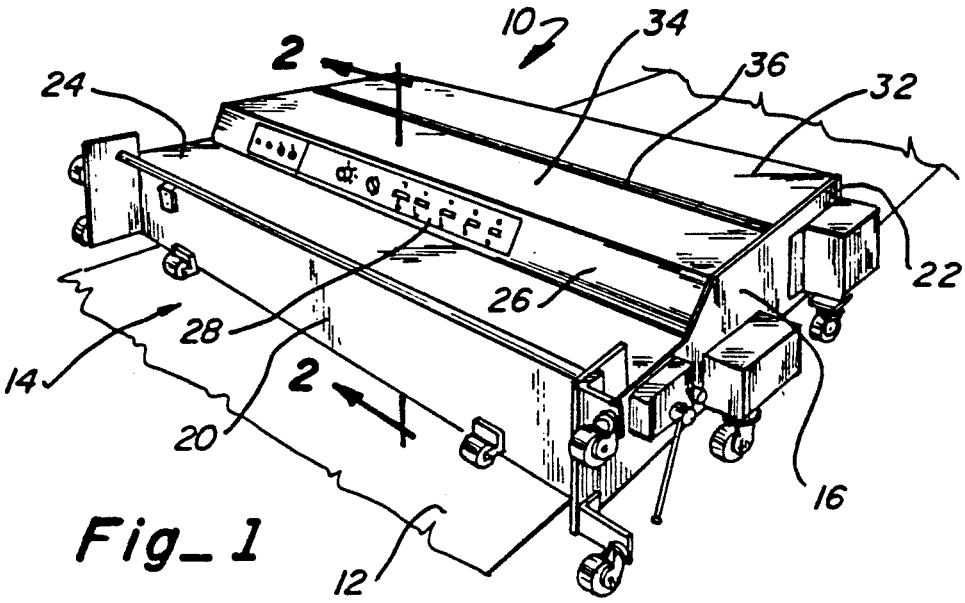
Fig_1
Fig_2
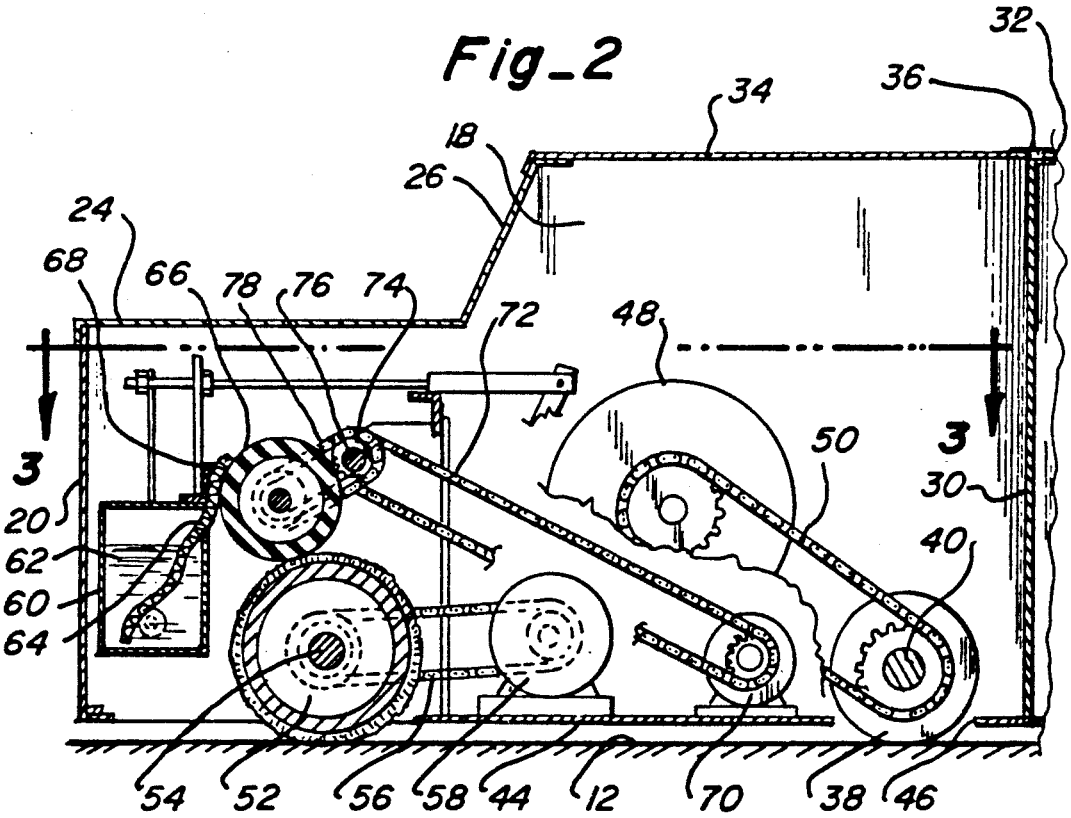

VARIABLE SPEED TRANSFER ROLLER FOR BOWLING LANE DRESSING APPARATUS

TECHNICAL FIELD

This invention relates to a transter roller mechanism for a bowling lane dressing apparatus and more particularly to one in which the speed of the transfer roller can be varied to more precisely control the amount of oil placed on a bowling lane.

BACKGROUND ART

Ingermann et al. U.S. Pat. No. 4,959,884 for "Combination Bowling Lane Stripper and Dressing Apparatus", among other limitations, discloses a transfer device for transferring dressing oil from a reservoir to an applicator roller. This device includes a transfer roller which receives oil from the reservoir by means of a wick and then transfers the oil to an applicator roller. The transfer roller is driven by a chain drive between it and the drive rollers for moving the device down the bowling lane. The device includes pressure fingers which can be adjusted to vary the amount of oil transferred from the reservoir to the transfer roller so that different amounts of oil can be applied to different boards across the width of the bowling lane. However, for any given pressure across the transfer roller, the amount of oil applied from the transfer roller to the buffer roller is strictly a function of the speed of the guide roller and can be varied only by varying the viscosity of the oil in the reservoir. Thus, the degree of control available with that device is limited.

DISCLOSURE OF THE INVENTION

In accordance with this invention, a bowling lane dressing apparatus is provided which has a carriage for movement along the bowling lane between the foul line and the pit. Drive wheels are rotatably mounted on the carriage for moving the carriage along the bowling lane by means of a first drive means connected thereto. A lane buffer roller is journaled on the carriage in lane-contacting relation which extends transversely to the direction of travel. The lane buffing roller is driven by a second drive means. A reservoir is mounted in the carriage for storage of lane-dressing fluid. A transfer roller is mounted in rolling engagement with the lane buffer roller and in fluid communication with the reservoir for transferring fluid from the reservoir to the lane buffer roller. Variable speed drive means is connected to the transfer roller for rotating it at variable speeds to vary the rate of transfer of fluid from the reservoir to the lane buffer roller.

More specifically, the variable speed drive means includes a variable speed motor mounted on the carriage and connected to the transfer roller to rotate the transfer roller at a speed relative to the speed of rotation of the variable speed motor. A variable resistor is connected in series with the variable speed motor for varying the speed thereof. Advantageously, this speed will range between 40 rpm and 100 rpm.

From the foregoing, it will be apparent that the application of lane-dressing fluid to a buffer roller will not be limited by the viscosity of the fluid, but rather can be controlled within broad limits by increasing or decreasing the speed of the transfer roller so that when the speed increases more fluid is applied to the buffer roller and when it is turned at a slower speed less fluid is applied to the buffer roller.

Additional advantages of this invention will become apparent from the description which follows, taken in conjunction with the accompanying drawings.

BRIEF DESCRIPTION OF THE DRAWINGS

FIG. 1 is a perspective view of a bowling lane dressing apparatus constructed in accordance with this invention;

FIG. 2 is an enlarged vertical section, taken along 2—2 of FIG. 1, showing the variable speed motor for operating the transfer roller;

BEST MODE FOR CARRYING OUT THE INVENTION

Figures 3, 4:
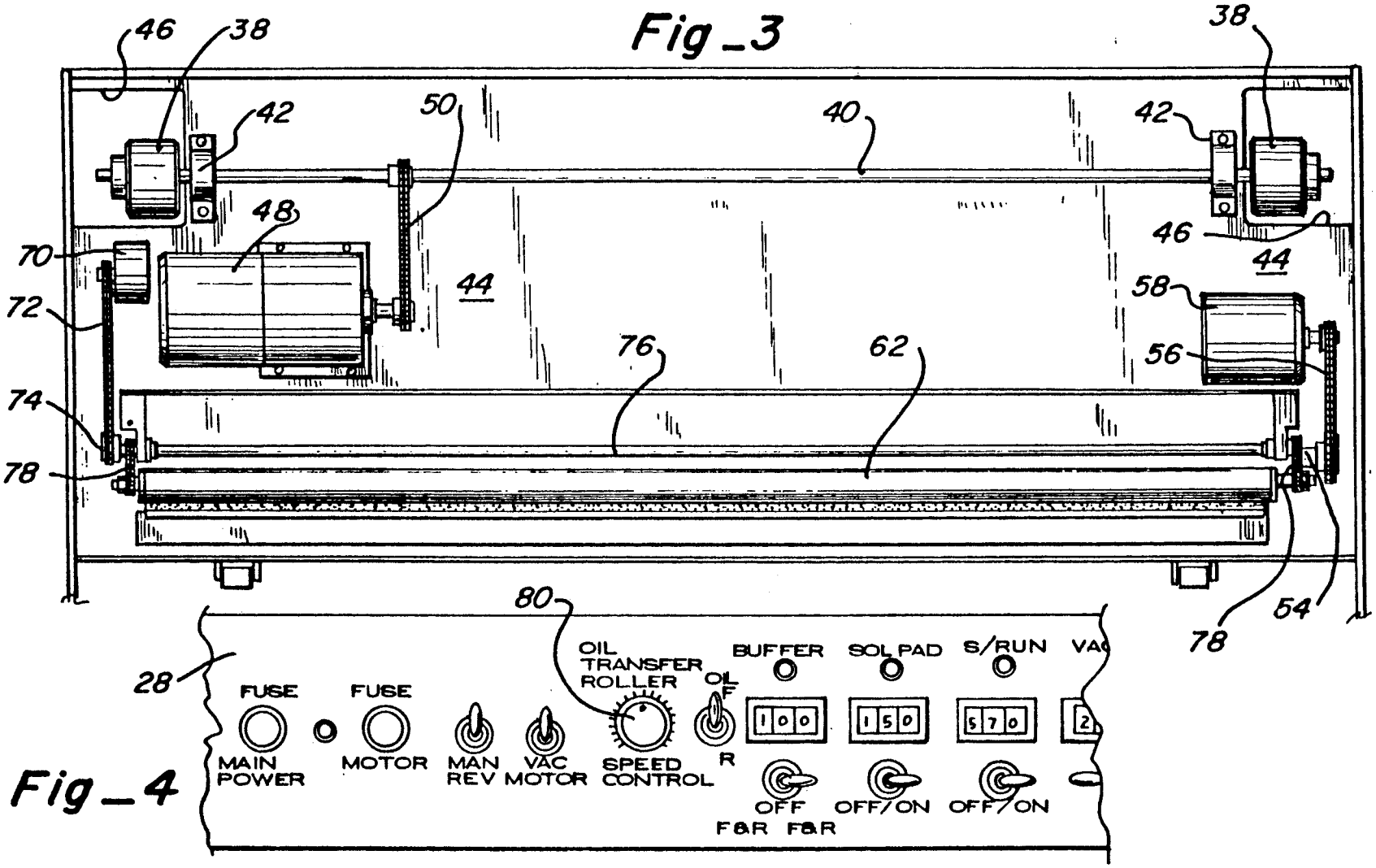
FIG. 3 is a horizontal section, taken along line 3—3 of FIG. 2, showing further details of the apparatus.
FIG. 4 is an enlarged fragmentary view of the control panel for the bowling lane dressing apparatus.

In accordance with the present invention, a dressing apparatus 10 is provided which can be mounted for travel along a bowling lane 12, as shown in FIG. 1. The apparatus has a carriage 14 which houses all of the functional elements of the apparatus. The carriage includes opposite side walls 16 and 18 interconnected by a front wall 20 and a rear wall 22. A top cover 24 extends from the upper edge of front wall 20 and terminates in an upstanding angular wall 26 in which a control panel 28 is mounted for controlling the various functions of the apparatus. A transverse wall 30, shown in FIG. 2, divides a forward portion of the carriage from a rear portion. The device is provided with a top cover having a pivotal section 34 connected to cover 32, as by a piano hinge 36 to provide access to the interior of carriage 14. Details of the mechanics of this device, other than those described below, can be found in Ingermann et al. U.S. Pat. No. 4,959,884 for "Combination Bowling Lane Stripper and Dressing Apparatus" which is incorporated herein by reference.

As best seen in FIGS. 2 and 3, the carriage 14 is provided with spaced drive wheels 38 interconnected by a rotatable shaft 40 journaled adjacent opposite ends and bearings 42. The drive wheels 38 engage the surface of bowling alley 12 for moving the carriage longitudinally along the alley for applying the lane dressing. Conveniently, carriage 14 has a bottom wall 44 having openings 46 therein through which drive wheels 38 extend for contacting the surface of bowling lane 12. A drive shaft 40 interconnects drive rollers 38 and is driven by drive motor 48 through chain drive 50.

The buffer roller 52 is mounted for rotation with central shaft 54 and is positioned to contact bowling alley 12 to apply the bowling lane dressing thereto. Shaft 54 is driven by a drive chain 56 from motor 58 at a constant speed.

A tank 60 is mounted adjacent buffer roller 52 within carriage 14 and contains a supply of dressing liquid 62. Conveniently, a wick 64 extends from the liquid to a position in engagement with transfer roller 66 which is in peripheral contact with buffer roller 52. Thus, the dressing liquid 62 will be transferred by wick 64 to transfer roller 66 and by transfer roller 66 to buffer roller 52. One or more pressure fingers 68 can be provided at the top of tank 60 for pressing the upper end of wick 64 against transfer roller 66 to control the rate at which liquid is transferred from wick 64 to transfer roller 66.

In the absence of any additional structure, the transfer roller 66 would be rotated by buffer roller 52 and would turn at a substantially constant rate of speed. However, in accordance with this invention, a variable speed motor 70 is provided. The motor is connected by means of a drive chain 72 to a sprocket 74. This sprocket is connected to the end of a shaft 76 which is interconnected to transfer roller 66 by a drive chain 78 at each end of the transfer roller.

Conveniently, the control panel 28 has a variable speed control 80 which includes a variable resistor in the form of a rheostat and is connected to variable speed motor 70 in a manner well understood by those skilled in the art. Thus, the speed of motor 70 can varied as desired to vary the speed of transfer roller 66. By speeding up the speed of transfer roller 66 more lane dressing fluid can be applied to buffer roller 52 and by slowing down transfer roller 66 less lane dressing fluid is applied to buffer roller 52. This arrangement provides a degree of control of the application of lane dressing fluid to the bowling lane which has not been possible with prior art apparatus. A typical prior art apparatus turns the transfer roller at 50 rpm. With applicant's invention the speed can be varied, such as between 40 rpm and 100 rpm.

This invention has been described in detail with reference to particular embodiments thereof, but it will be understood that various other modifications can be effected within the spirit and scope of this invention.

We claim:

1. A bowling lane dressing apparatus comprising:

a carriage for movement along a bowling alley between a foul line and pit;

drive wheels rotatably mounted on said carriage in lane-contacting relation and extending transversely to the direction of travel;

a reservoir in said carriage for the storage of lane-dressing fluid;

a lane buffer roller journaled on said carriage for rotation with its surface in lane-contacting relation to transfer lane dressing fluid to the bowling alley;

a transfer roller mounted in rolling engagement with said lane buffer roller and in fluid communication with said reservoir for transferring fluid from said reservoir to said lane buffer roller; and variable speed drive means connected to said transfer roller for rotating it at variable speeds to vary the rate of transfer of fluid from said reservoir to said lane buffer roller.

2. Apparatus, as claimed in claim 1, wherein said variable speed drive means comprises:

a variable speed motor mounted on said carriage connected to said transfer roller to rotate said transfer roller at a speed relative to the speed of rotation of said variable speed motor; and a variable resistor connected to said variable speed motor for varying the speed of said variable speed motor.

3. Apparatus, as claimed in claim 2, wherein:

the speed of said variable speed motor is variable between 40 rpm and 100 rpm.

4. A bowling lane dressing apparatus comprising:

a carriage for movement along a bowling alley between a foul line and pit;

drive wheels rotatably mounted on said carriage in lane-contacting relation and extending transversely to the direction of travel;

a reservoir in said carriage for the storage of lane-dressing fluid;

a lane buffer roller journaled on said carriage for rotation with its surface in lane-contacting relation to transfer lane dressing fluid to the bowling alley;

a transfer roller mounted in rolling engagement with said lane buffer roller and in fluid communication with said reservoir for transferring fluid from said reservoir to said lane buffer roller;

a first drive means connected to said drive wheels for rotating the same to move said carriage along the bowling alley;

a second drive means for rotating said lane buffer roller; and variable speed drive means connected to said transfer roller for rotating it at variable speeds to vary the rate of transfer of fluid from said reservoir to said lane buffer roller.

5. Apparatus, as claimed in claim 4, wherein said variable speed drive means comprises:

a variable speed motor mounted on said carriage connected to said transfer roller to rotate said transfer roller at a speed relative to the speed of rotation of said variable speed motor; and a variable resistor connected to said variable speed motor for varying the speed of said variable speed motor.

6. Apparatus, as claimed in claim 5, wherein:

the speed of said variable speed motor is variable between 40 rpm and 100 rpm.

* * * * *